United States Patent [19]

Beyl

[11] 3,933,361

[45] Jan. 20, 1976

[54] SKI BRAKING DEVICE

[76] Inventor: Jean Joseph Alfred Beyl, Boulevard Victor Hugo, Nevers, France

[22] Filed: Feb. 21, 1975

[21] Appl. No.: 551,905

[30] Foreign Application Priority Data

Mar. 1, 1974 France ..... 74.06969

[52] U.S. Cl. ..... 280/11.13 B

[51] Int. Cl.[2] ..... A63C 7/10

[58] Field of Search... 280/11.13 B, 11.13 C, 11.13 D, 280/11.132

[56] References Cited

UNITED STATES PATENTS

| | | | |
|---|---|---|---|
| 2,194,979 | 3/1940 | Jett | 280/11.13 C |
| 2,316,252 | 4/1943 | Karlsson | 280/11.13 C |
| 3,715,126 | 2/1973 | Schwarz | 280/11.13 B |
| 3,741,575 | 6/1973 | Bortoli | 280/11.13 B |

FOREIGN PATENTS OR APPLICATIONS

| | | | |
|---|---|---|---|
| 638,773 | 3/1962 | Canada | 280/11.13 B |

*Primary Examiner*—M. H. Wood, Jr.
*Assistant Examiner*—Milton L. Smith
*Attorney, Agent, or Firm*—Jordan B. Bierman; Linda G. Bierman; Kenneth J. Stempler

[57] ABSTRACT

A ski braking device adapted to be preset automatically by fitting the ski boot to the ski. It comprises essentially a pair of braking arms having a common transverse shaft. These arms are normally parallel to the top surface of the ski and their shaft is rigid with a crank arm pivoted to a longitudinally movable member associated with spring means and adapted to transform the movement of rotation of said shaft into a movement of translation of said longitudinally movable member against the resistance of a spring. This arrangement constitutes a knee action mechanism and the device can operate efficiently whether the ski is sliding downhill with the ski tip or the heel end first. Means for locking the device against operation for transport or other purposes are provided.

2 Claims, 8 Drawing Figures

SKI BRAKING DEVICE

The present invention relates to braking devices designed for mounting on a ski with a view to stop the free sliding thereof on the snow surface after its separation from the skier's boot, for example in case of fall having caused the release of the corresponding binding.

This device is of the type comprising a pivoting brake lever adapted to be brought into frictional engagement with, or to penetrate into, the snow under the action of a return spring. This brake lever is rigid with a rotary shaft extending across the ski and comprises advantageously a pair of arms disposed on either side of the ski.

In the inoperative position, the arm or arms of said brake lever is or are retained in an upper or raised position, for example a position in which said arm or arms is or are substantially parallel to the ski axis so as to be prevented from contacting the snow surface. The brake lever may be held in this position by a control member actuated when positioning the corresponding boot on the ski. Thus, as long as the ski boot is normally positioned on the ski, the brake lever is held in said upper position and no braking force is exerted on the ski. When the ski boot escapes from the ski, this brake lever is released and its return spring tends to move said lever to its operative or braking position in which said arm or arms project from the underface of the ski so as to rub the snow surface or penetrate into it.

The device according to this invention is designed with a view to provide a number of advantages in comparison with hitherto known devices of this character.

The first advantage characterising this device is that it provides the same braking action whether the ski is sliding in one or the opposite direction, that is, when the ski slides in its normal direction or when it slides with the heel facing downhill.

Another advantageous feature characterising this invention is that when the aforesaid arms of the device are in their operative position, a progressively increasing resistance is provided, this resistance having its lowest value when the aforesaid arms are substantially perpendicular to the bottom surface of the ski. The reason of this specific arrangement is to reduce the risks likely to derive from this braking device in case the latter happened to strike a skier, for in this occurrence the braking arms would have the possibility of assuming a position coplanar with the ski during a shock. However, the progressiveness of the resistance offered by these arms would not interfere under any circumstances with an efficient braking action for the arm folding movement would become gradually more difficult and therefore the braking force or efficiency would increase as a function of the sliding speed attained by the ski.

Besides, the basic principle of the device of this invention also affords many other advantages which will appear as the following description proceeds.

This ski braking device is characterised essentially in that the shaft supporting the braking arm or arms is coupled through mechanical means adapted to transform its movement of rotation into a movement of translation with a member movable longitudinally in one or the other direction, said member being responsive to a compression coil spring reacting against another member substantially fixed in the longitudinal direction.

With this arrangement, the braking action exerted by the movable arm or arms is the same in both directions. On the other hand, the braking resistance increases as the arm or arms tend to be pivoted back against the ski, this resistance having its lowest or minimum value when said arms are substantially perpendicular to the ski.

In a specific form of embodiment of the present device the means for interconnecting the shaft of said braking lever and the longitudinally movable member consists of a crank arm rigid with said shaft and pivoted to one end of said longitudinally movable member, said one end being displaceable on one or the other side in relation to a plane parallel to said ski and containing the axis of said braking lever.

In another advantageous form of embodiment of this device the coupling means provided between the shaft of said braking lever and the longitudinally movable member comprise a toothed pinion rigid with said shaft and a rack formed integrally with, or rigidly connected to, said movable member.

However, other features and advantages of this device will appear as the following description proceeds with reference to the accompanying drawings, in which.

Figure 1:
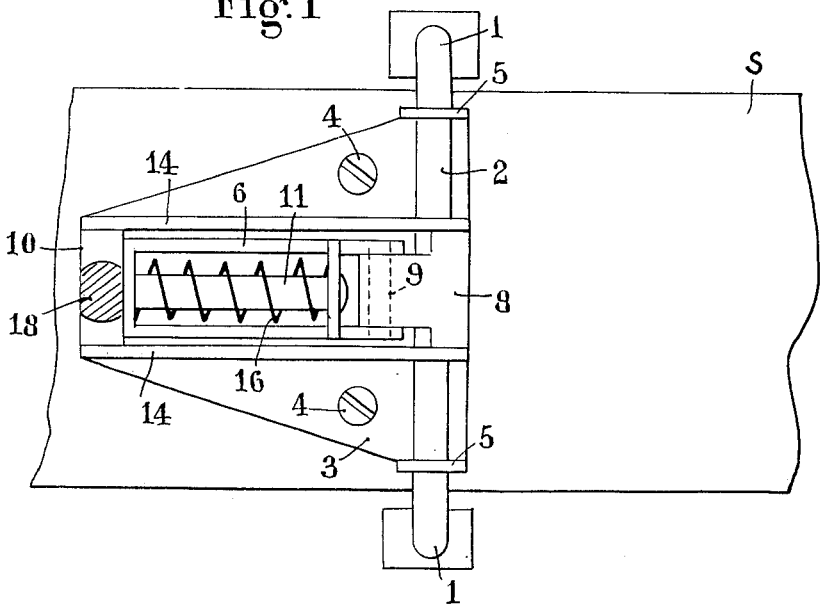
FIG. 1 is a plan view from above showing a first form of embodiment of the ski braking device according to this invention, this device being shown in its operative or braking position.

In the form of embodiment illustrated in FIGS. 1 to 5 of the drawings the ski braking device according to this invention comprises a pair of braking levers 1 consisting of the two lateral arms of a substantially U-shaped member of which the central section 2 constitutes the pivot shaft. This shaft 2 is rotatably mounted in holes or notches formed in a pair of upstanding lugs 5 disposed adjacent the two lateral sides of the ski S and forming an integral part of a base member or plate 3 secured to the top surface of the ski S by means of screws 4 or any other suitable fastening members.

Figure 2:
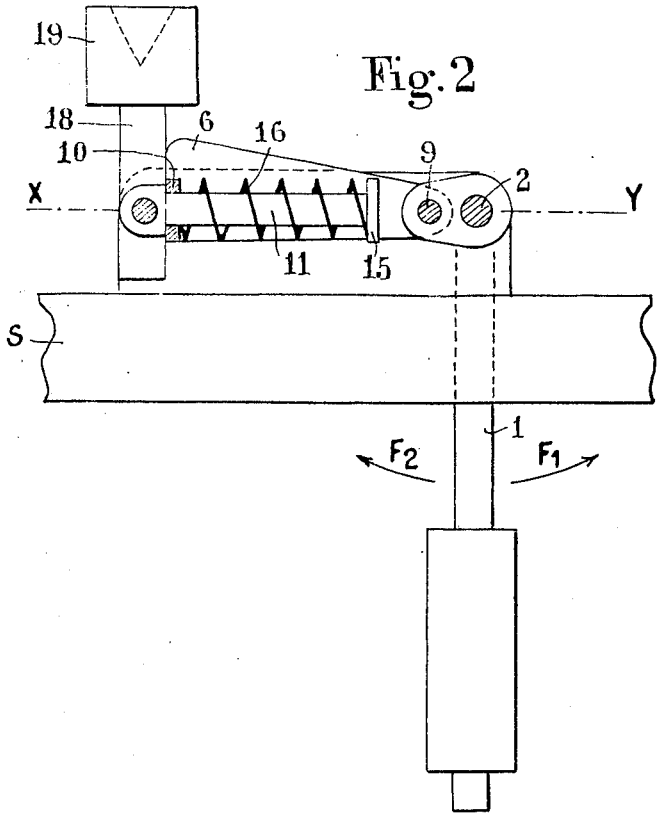
FIG. 2 is a corresponding side elevational view of the same device.

The shaft 2 is coupled with a member 6 movable in the longitudinal direction of the ski and responsive to a return spring 7 serving the purpose of constantly urging this member 6 to the position in which both braking arms 1 project downwards normally to the lower or bottom surface of the ski S (FIG. 2).

The shaft 2 is coupled to said movable member 6 through the medium of a member 8 rigid with said shaft and constituting a kind of crank arm. This crank arm 8 has its outer end pivoted to an adjacent end of said movable member 6 by means of a pin 9. In the example illustrated, this member 6 is substantially U-shaped and the pivot pin 9 extends between the two lateral arms thereof.

The opposite end 10 of member 6 comprises an aperture constituting a guide means for a rod 11 having its yoke-shaped end 12 located externally of the U-shaped member 6 and pivotally mounted by means of a fixed transverse pivot pin 13 to a pair of lateral wings 14 of a channel member formed integrally with the aforesaid base member or plate 3. Of course, the crank 8 and U-shaped member 6 are also located between the lateral wings of said channel member.

At its opposite end, the rod 11 carries a flat head 15 engaged by one end of a return spring 16 reacting at its opposite end against the end 10 of said movable member 6.

Due to their specific nature, the coupling means provided between said shaft 2 and movable member 6 tend to transform the movements of rotation of said shaft 2 into movements of longitudinal translation of the U-shaped member 6 in one or the other direction. However, according to the action exerted on said arms 1, the pivot pin 9 carried by the corresponding end of U-shaped member 6 can move to one or the other side of the horizontal plane X–Y containing the axis of shaft 2 which is parallel to the top surface of the ski S.

Figure 3:
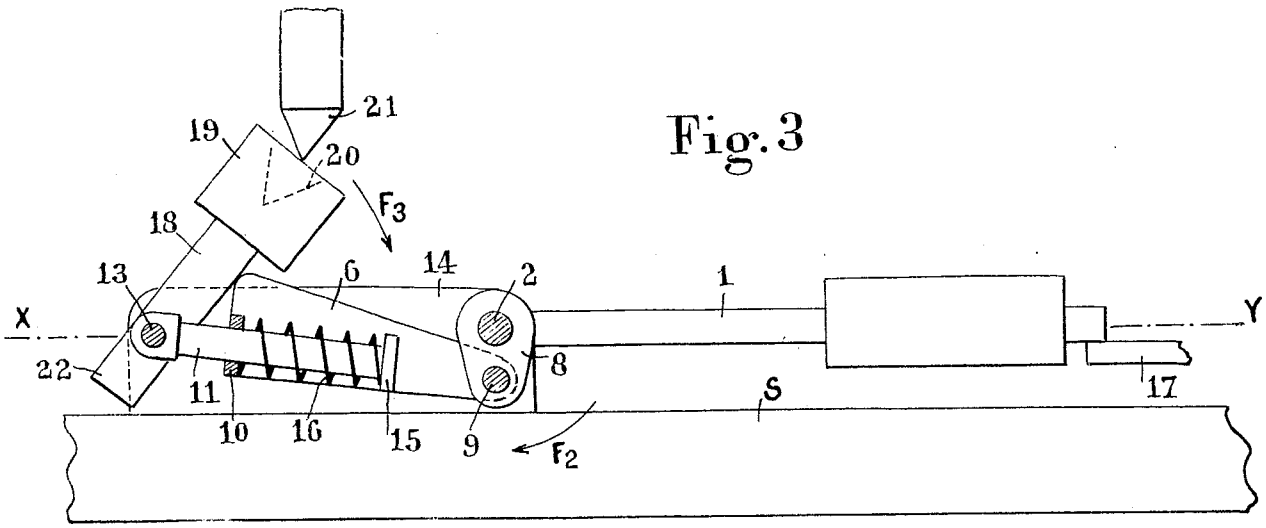
FIG. 3 is a view similar to FIG. 2 illustrating the device in its inoperative position, or before its actuation.

Thus, if the braking arms 1 are pivoted to the rear as shown by the arrow $F_1$, the pivot pin 9 is caused to move to a position beneath the plane X–Y (see FIG. 3). On the other hand, if these arms are pivoted in the direction of the arrow $F_2$, said pivot pin 9 is caused to move to a position above said plane X–Y (see FIG. 5).

However, the force of return spring 7 tends to keep the three axes of pivots 2, 9 and 13 in coplanar relationship. Now, by construction the two braking arms 1 are disposed substantially normally to the bottom surface of the ski (see FIG. 2). Under these conditions, these two arms 1 are in their active or braking position and can rub the snow or penetrate into it to stop the ski by preventing the free sliding thereof on the snow surface.

However, these arms 1 are adapted to be held in their upper, inoperative position as shown in FIG. 3 as long as the corresponding ski boot is properly positioned on the ski S. The arms 1 may be retained in this inoperative position by any suitable control member adapted to be actuated by the boot when the latter is fitted to the ski binding.

This member may consist for example of a U-shaped member pivoted on the ski and having one end shaped to constitute a pedal engageable by the boot, the opposite ends of this U-shaped member being engaged in this case under the end portions of the pair of braking arms 1, as illustrated in FIG. 3. Under these conditions, the device itself must be mounted to the ski ahead of the front or toe binding device, or, alternatively and in contrast thereto, at the rear of the heel hold-down device of the ski binding, the retaining pedal being mounted at the location contemplated for receiving the boot. As long as the boot remains in its operative position on the ski, the two braking arms are kept in their raised or inoperative position, but when the boot leaves the ski for any reason these two arms are released and can thus pivot in the direction of the arrow $F_2$ to their operative or braking position illustrated in FIG. 2.

The braking action is the same in both directions, i.e. whether the ski is sliding dowhill with the ski-tip or its heel end pointing ahead.

In the first case, the braking arms 1 tend to pivot in the direction of the arrow $F_1$ due to the resistance caused by the rubbing contact between said arms and the snow, and in the second case they tend to pivot in the direction of the other arrow $F_2$ for the same reason. However, the pivoting conditions are exactly the same in either case and the action of the return spring 16 is also the same. This is due of course to the fact that this spring 16 controls the member 6 mounted for longitudinal movement and also to the specific nature of the coupling means contemplated between this member 6 and pivot shaft 2.

On the other hand, irrespective of the direction of the pivotal movement accomplished by the braking arms 1, the rotation of shaft 2 is attended by a movement of longitudinal translation of the member 6 to the rear, so that the pivot pin 9 is caused to move towards one side or the opposite side of the above-defined plane X–Y, as already explained in the foregoing. But in either case the action of spring 16 is exactly the same and tends to restore the arms 1 to their normal braking position illustrated in FIG. 2.

Yet another feature characterising this invention lies in the fact that the braking effort is of progressive nature as the arms 1 depart from their normal position shown in FIG. 2. In fact, the greater the departure of said arms 1 from this normal position, the greater the compression of return spring 16 and the greater the resistance offered by this spring. Therefore, the lowest spring resistance is encountered when the arms 1 are in the position illustrated in FIG. 2. Now this obviously constitutes an important advantage likely to minimize the risks of injuries in case the ski provided with the device of the present invention happens to strike another skier. In fact, the braking arms 1 can in this case pivot in one or the other direction to prevent a severe shock or blow.

Furthermore, when the ski thus released from the boot is sliding on the snow surface the braking arms 1 tend to be pushed back in one or the other direction and encounter a gradually increasing resistance ensuring an efficient braking action. The greater the tendency of the ski to increase its speed, the stronger the braking action exerted by the device.

Preferably, the device according to this invention comprises additional means for controlling the lifting of said arms 1 to their inoperative position (FIG. 3) so that they can subsequently be retained in this position by means of the retaining pedal 17.

However, means may also be contemplated for locking these braking arms in their upper, inoperative position during a prolonged time period, for example when transporting the ski. In the form of embodiment illustrated in FIGS. 1 to 5 of the drawings these means merge into one and consist of a small thrust lever 18 pivoted to the pin 13. At the upper end this small lever 18 comprises an integral control head 19 (not shown in FIG. 1) formed with a countersunk cavity 20 adapted to receive the tip 21 of a ski pole. Thus, the user may engage this tip into the head cavity 20 of thrust lever 18 to pivot the latter in the direction of the arrow $F_3$ (see FIG. 3) in order to push the movable strap 6 backwards and thus move the pivot pin 2 to the position in which the two braking arms 1 are raised to their inoperative or neutral position.

Figure 4:
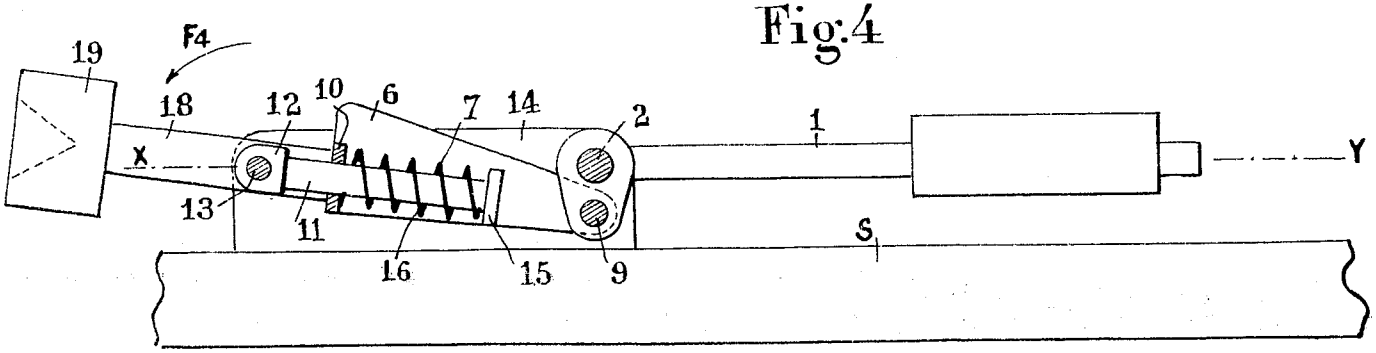
FIG. 4 is a similar view showing the device in its neutral position, for instance when the ski is to be transported.
Figure 5:
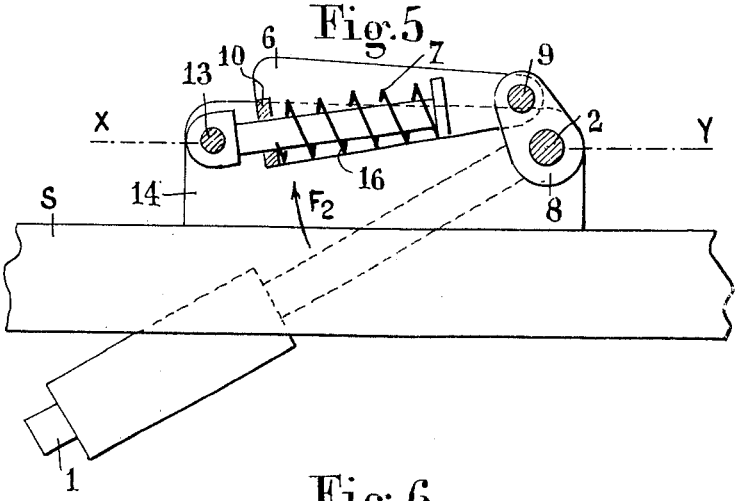
FIG. 5 is a similar view showing the device during the forward movement of the braking arms.

However, it is also possible to actuate the head 19 of thrust lever 18 manually for pivoting this lever 18 in the direction of the arrow $F_4$ to the position illustrated in FIG. 4. This also permits of rotating the pivot shaft 2 to the desired position for raising the braking arms 1, but at the same time the opposite end 22 of thrust lever 18 will engage the end 10 of movable member or strap 6 so as to push and lock same in a stable position. The braking arms 1 are thus held against movement in their upper position without requiring the holding of pedal 17 in the corresponding upper or released position.

The two means contemplated for controlling the braking arms 1 and locking these arms permanently, for instance when it is desired to transport the ski, may differ widely from those described and illustrated herein which are given by way of illustrative example only. Besides, these two types of means may be dissociated, if desired.

Figure 6:
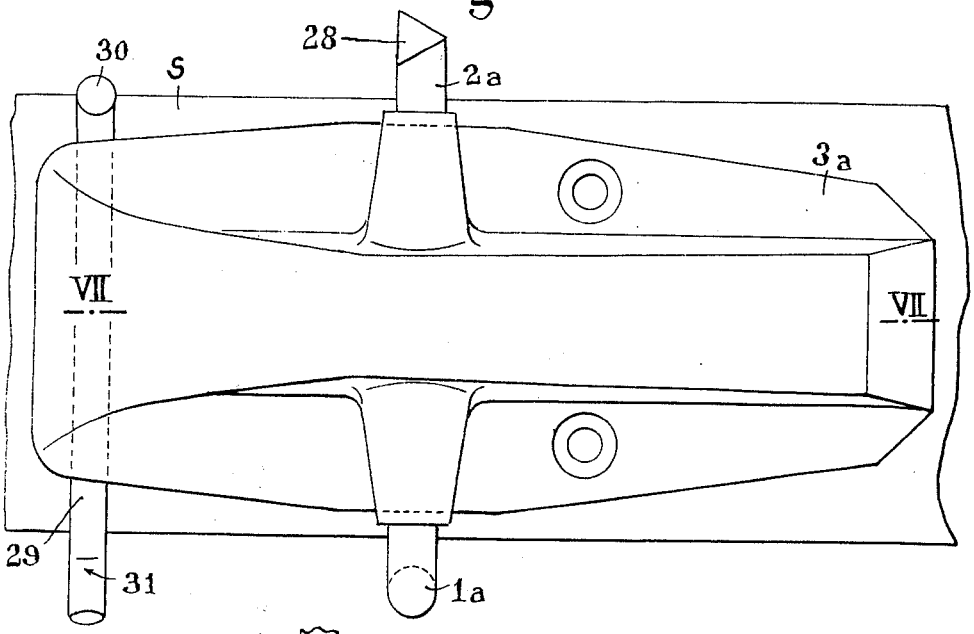
FIG. 6 is a plan view from above showing a different form of embodiment of the device.
Figure 7:
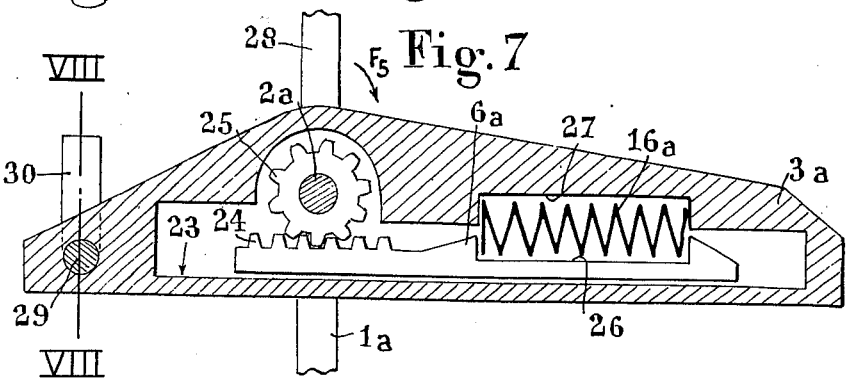
FIG. 7 is a section taken along the line VII—VII of FIG. 6.

FIGS. 6 and 7 illustrate another form of embodiment of the ski braking device of this invention wherein the common shaft 2*a* of the pair of braking arms 1*a* is also operatively connected or coupled to a member mounted for movement in the longitudinal direction by means of mechanical elements adapted to convert the movement of rotation of this shaft 2*a* into a movement of longitudinal translation. The element thus contemplated consists in this case of a slide 6*a* movable in a guiding slideway 23 formed in the hollow base member 3*a* secured to the top surface of the ski.

The coupling means between this slide 6*a* and shaft 2*a* consist of a combination of a rack 24 formed on this slide with a toothed pinion 25 rigid with shaft 2*a*.

The return spring 16*a* controlling the slide 6*a* is a coil compression spring as in the preceding form of embodiment. However, in the present instance the spring 16*a* bears with one end against a fixed element and with the opposite end against one portion of said slide 6*a*. Thus, whatever the direction in which said slide is moved, the spring 16*a* constantly tends to restore it to its position shown in FIG. 7 wherein the braking arms 1*a* are disposed substantially at right angles to the bottom surface of the ski S.

To this end, the return spring 16*a* is enclosed or contained partly in a recess 26 formed in said slide 6*a* and partly in the inner cavity of said base member 3*a*.

Under these conditions, the operation of the ski braking device according to this modified form of embodiment is substantially the same as in the case of the first form of embodiment, and exactly the same advantages are obtained in either case. In fact, the braking action is unchanged and effective irrespective of the direction in which the ski is sliding. On the other hand, the braking effort is applied progressively and the resistance produced by the return spring decreases as the braking arms approach their position at right angles to the main ski surface.

Of course, this device is also provided with control means permitting of raising the braking arms to their inoperative position so that they can be held in this position by means of a retaining pedal 17 or any other suitable device adapted to be actuated automatically when the boot is fitted to the ski binding.

In the form of embodiment illustrated in FIGS. 6 and 7 the means controlling the lifting of said braking arms 1*a* consist of a lever 28 rigid with shaft 2*a* but extending in a direction opposite to that of the relevant braking arm 1*a*. When the braking arms are in their operative position, this lever 28 projects upwards (see FIG. 7). To retract the braking arms to their inoperative position it is only necessary to exert a pressure on the upper end of said lever 28 so as to tilt same forwards, i.e. in the direction of the arrow $F_5$. Thus, the braking arms 1*a* may be brought into locking engagement with the corresponding ends of retaining pedal 17.

Figure 8:
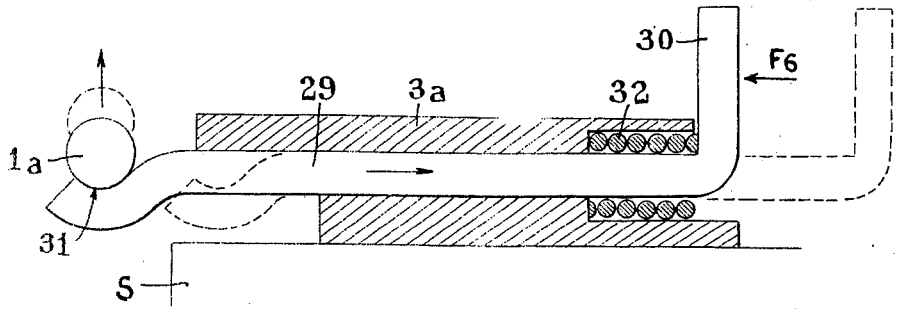
FIG. 8 is a section taken along the line VIII—VIII of FIG. 7.

Furthermore, the device illustrated in FIGS. 6 and 7 of the drawings comprises means for holding the braking arms 1*a* in their upper or inoperative position during the transport or other handling of the ski. These means consist of a movable bolt or rod 29 slidably mounted in a transverse bore formed in said base member 3*a*. One end of this rod carries a knob 30 or other projecting member for actuating same manually. The opposite end of bolt 29 projects somewhat from the corresponding lateral side of base member 3*a* under the location of the corresponding braking arm 1*a* when the latter has been lifted to its inoperative position. This end is advantageously cranked, as shown in FIG. 8, to provide a seat 31 adapted to receive the corresponding braking arm 1*a*. However a return spring 32 housed within the base member 3*a* constantly urges the locking bolt 29 to its retracted or release position shown in dash lines in FIG. 8.

To bring the bolt 29 to its arm-locking position it is only necessary to exert a thrust in the direction of the arrow $F_6$ on the control end 30 of this bolt, so that the seat 31 formed at the operative end thereof will position itself under the corresponding arm 1*a*. Due to the action of return spring 16*a*, this arm 1*a* is urged against the locking bolt 29 and locked against movement and the force of its return spring 32. To release the lock bolt 29 and allow same to resume automatically its retracted position under the force of said spring 32 it is only necessary to lift slightly the braking arms 1*a*.

Under these conditions the user may fix his ski boot and preset the present braking device by applying two different methods, indifferently.

In the first method, the user presets the device by fitting the ski boot on the relevant ski while the braking arms 1*a* are in their projecting or service position. This method is advantageous in that these arms will thus prevent the ski from sliding untimely, for instance before the skier has properly fitted the boot in its binding.

When the boot is fastened in position the retaining pedal 17 is moved automatically to its position in which it retains the braking arms 1*a* in their raised position. However, since these arms project in this case beneath the bottom surface of the ski S, the lever 28 must be actuated, for example by using the tip of a ski pole, for lifting said arms above the corresponding ends of pedal 17 so as to lock them by means of this pedal 17. Thus, the braking device is ready to operate but remains in its non-braking or neutral position.

In the second method of presetting the device of this invention the user fits his ski boot in the ski binding while leaving the braking arms 1*a* locked in their upper or neutral position by means of lock bolt 29. In this case, the ends of the retaining pedal 17 engage the underface of arms 1*a* to subsequently hold them in their upper position. However, the arrangement is such that the ends of said pedal 17 will then lift slightly the braking arms 1*a* above the level of lock bolt 29. Under these conditions, this lock bolt 29 is released and resumes automatically its retracted position (in dash lines in FIG. 8) and the braking device is ready to operate.

In either case the braking device is preset automatically without requiring any particular intervention from the skier. Therefore, any risk of locking the device in its upper or inoperative position is safely precluded during the normal use of the skis, in contrast to certain known prior art devices of the same type.

Of course, the means contemplated in the form of embodiment illustrated in FIGS. 6 to 8 for on the one hand lifting the braking arms 1*a* and on the other hand locking these arms in their transport position may be adapted to the form of embodiment illustrated in FIGS. 1 to 5 of the drawings, as a substitute for the lever 18 described in the foregoing. Besides, any other suitable means may be contemplated in both forms of embodiment for controlling the lifting of the braking arms 1*a* and locking them for transport or other purposes.

In addition to the above-disclosed advantages, the device according to the present invention provides a number of additional advantageous features, notably the fact that, due to its original conception, this device cannot interfere with the normal operation of the safety binding mounted on the ski. In fact, this device is located outside the area normally reserved for the ski boot and its binding, so that any detrimental frictional contact therewith is safely avoided.

Besides, the means such as pedal 17 or other similar member for retaining the braking arms in their upper position cannot interfere with the normal operation of the safety ski binding due to the existing lever arms providing a minimum pressure against the ski boot.

Another advantage deriving from the use of the device of this invention lies in the fact that in case of untimely release thereof the braking arms can pivot on the snow without any risk of causing a severe fall of the skier. Besides, a beginner can of course use his skis without positioning the braking arms in their raised position, so that he can keep his or her balance even on a very steep grade.

As already mentioned in the foregoing, many modifications may be brought to the device described and illustrated herein without departing from the basic principles thereof as disclosed in the appended claims.

What is claimed as new is:

1. Ski braking device for stopping the free sliding of a ski on snow in case the ski is accidentally or otherwise separated from the ski boot comprising a pivoting braking lever adapted to be brought into frictional contact with, or sunk into, the snow under the force of a spring, said lever being rotatably rigid with a rotary shaft extending across the ski, said rotary shaft being coupled through mechanical means adapted to convert rotation of the shaft into translation of said mechanical means, said mechanical means comprising a toothed pinion rigid with said shaft and a rack portion, said rack portion being movable in the longitudinal direction and responsive to a compression spring reacting against a member substantially fixed in the longidutinal direction.

2. Ski braking device according to claim 1 wherein said compression spring bears with either end against one portion of said rack portion and a fixed member, respectively.

* * * * *